US006951157B1

(12) United States Patent
Tedrick

(10) Patent No.: US 6,951,157 B1
(45) Date of Patent: Oct. 4, 2005

(54) WRENCH, ADJUSTABLE WITH LOCKING PIN

(76) Inventor: John Tedrick, 4937 S. 68th E. Ave., Tulsa, OK (US) 74145

( * ) Notice: Subject to any disclaimer, the term of this patent is extended or adjusted under 35 U.S.C. 154(b) by 0 days.

(21) Appl. No.: 10/795,855

(22) Filed: Mar. 9, 2004

(51) Int. Cl.[7] ..... B25B 13/14
(52) U.S. Cl. ..... 81/165; 81/170; 81/DIG. 3
(58) Field of Search ..... 81/165, 170, DIG. 3, 81/155, 166, 167

(56) References Cited

U.S. PATENT DOCUMENTS 1,148,410 A * 7/1915 Smith et al. ..... 81/165
1,498,656 A * 6/1924 Herby ..... 81/165
1,512,846 A * 10/1924 Gumprecht ..... 81/165
2,341,564 A * 2/1944 La Pierre ..... 81/DIG. 3
2,722,150 A * 11/1955 Green ..... 81/165
2,729,999 A * 1/1956 Barnes ..... 81/165
3,023,653 A * 3/1962 Finn et al. ..... 81/165
3,024,683 A * 3/1962 Finn et al. ..... 81/165
4,548,104 A * 10/1985 Hendricks ..... 81/165

* cited by examiner

*Primary Examiner*—Jacob K. Ackun, Jr.

(57) ABSTRACT

Adjustable wrenches have been in use for more than 100 years. They have been "slipping out of adjustment" for the same time frame. Many solutions to this problem have been proposed, some have been patented. This is my offering.

1 Claim, 3 Drawing Sheets

WRENCH, ADJUSTABLE WITH LOCKING PIN

BACKGROUND OF THE INVENTION

1. Field of the Invention

This invention relates in general to a wrench, and in particular to a parallel, slidable jaw wrench used to tighten or loosen nuts, bolts, valve stems, or items requiring turning. Adjustable wrenches have been used for many years and are still in use today. Most mechanics, machinists, millwrights, plumbers, and electricians have this wrench in their tool box.

The wrench in its present configuration is entirely suitable for casual use. However, for extended use, doing a job repeatedly, a device for locking the adjustment would be desirable.

2. Description of Related Art

While making a patent search I have found a number of adjustable wrench patents with some form of locking device. Such as;

Keller U.S. Pat. No. 1,444,793, Swanstrom U.S. Pat. No. 2,849,908, Lindgran U.S. Pat. No. 3,857,308, Spector U.S. Pat. No. 5,222,419, Haskell U.S. Pat. No. 5,540,125, Gustafson U.S. Pat. No. 5,644,957.

None of these inventors use a locking method such as I have shown in this invention.

DESCRIPTION OF THE INVENTION

An adjustable wrench comprising a body having a handle, a fixed jaw (21), a moveable jaw (22) having a guiding flange and a rack gear, a bore having a slot to accept the moveable jaw, a window (28) to accept a rotatable worm

(23), a bore to accept a worm shaft (24), a bore (26) to accept a locking pin (25), a rotatable worm having threads to mate with said moveable jaw rack gear, a locking pin, said rotatable worm being held in said window by said worm shaft in said worm shaft bore, and mating with said moveable jaw rack gear, said rotatable worm having one or more arrays of notches (27) milled across the circumference, said locking pin mating with one of said arrays of notches and aligning and entering said locking pin bore.

DESCRIPTION OF THE DRAWINGS

FIG. (1) is a plan view of the wrench showing the moveable jaw in the open position. The locking pin is shown in the inserted position.

FIG. (2) is a cross sectional view of the wrench showing the pin in the locking position.

Figure 1:
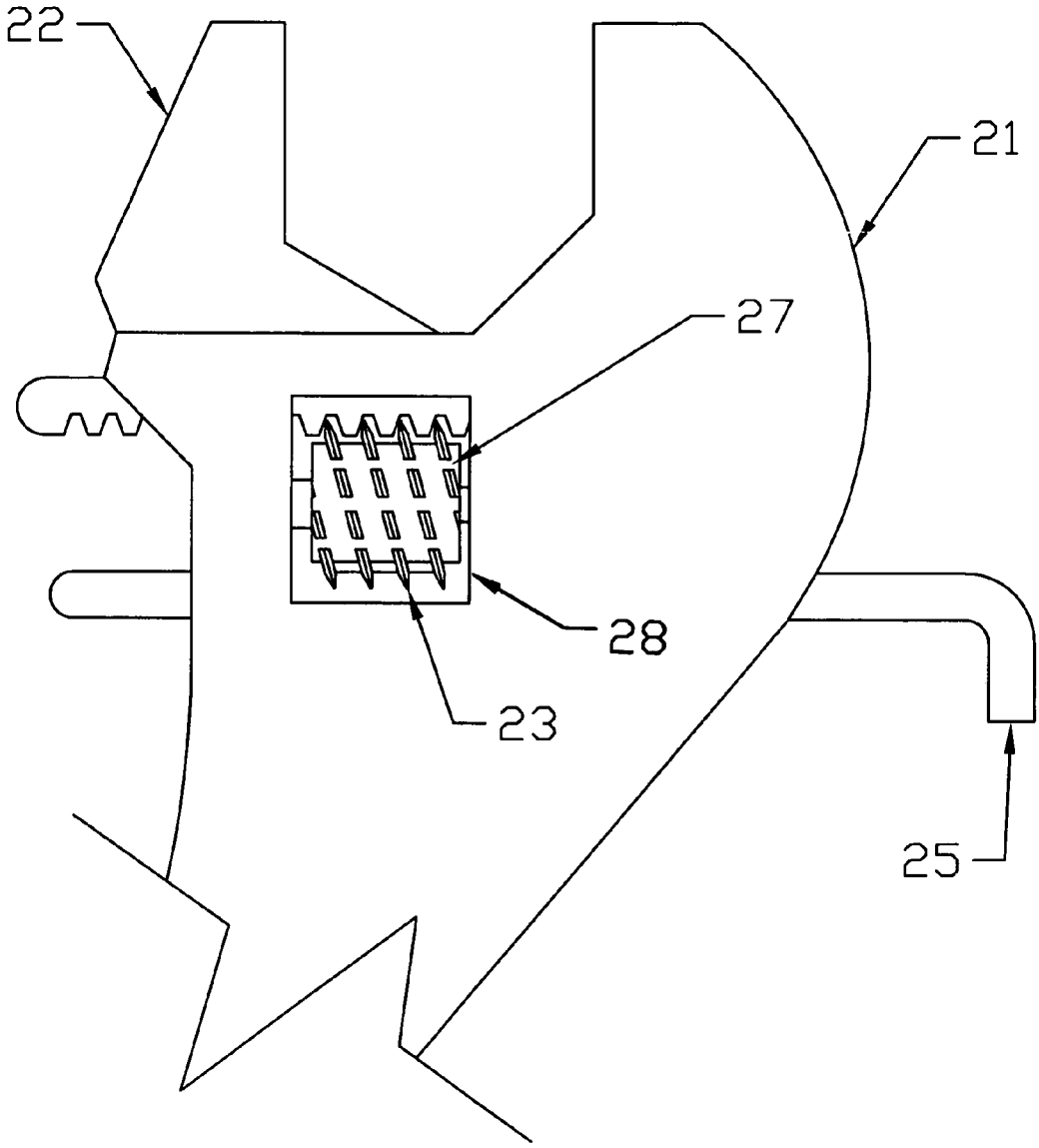
Figure 2:
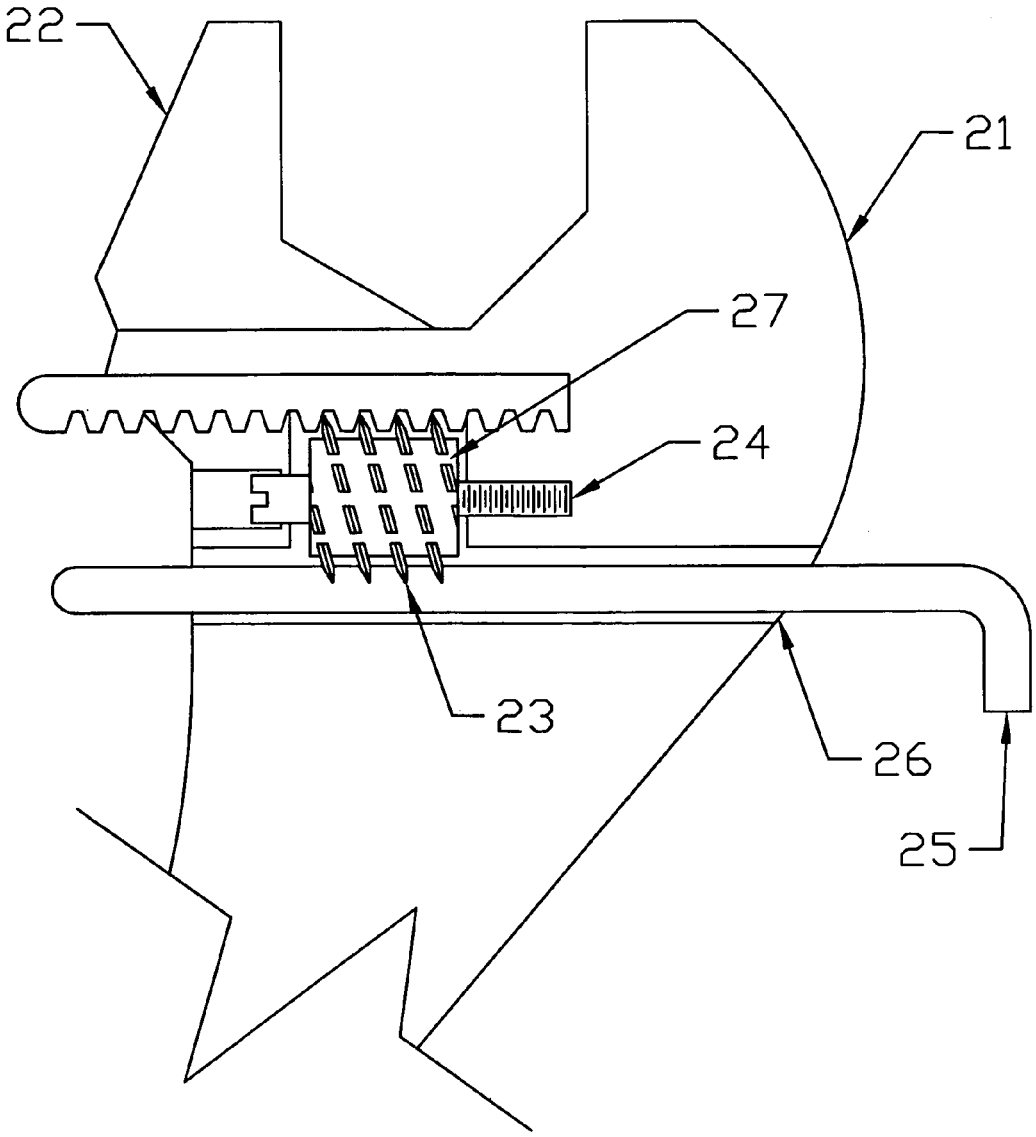
Figure 3:
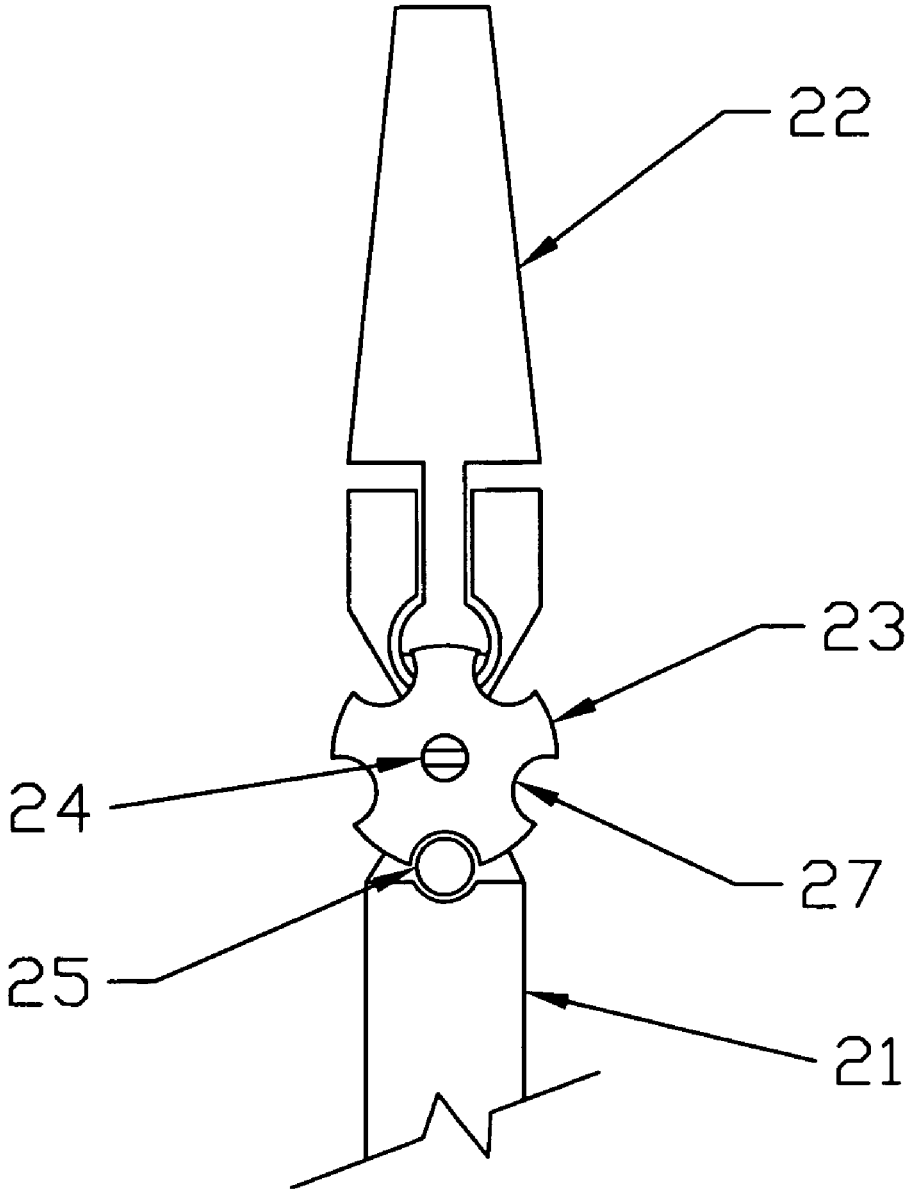

FIG. (3) is an end view of the wrench showing the array of notches in the worm cooperating with the locking pin.

What is claimed is:

1. An anti-drift improvement for an adjustable wrench having a movable jaw with a rack gear driven by a worm gear, the improvement comprising: a bore into a body of the wrench parallel to a shaft of the worm gear with a chordal portion overlapping teeth of the gear, said teeth having one or more arrays of notches extending parallel to said bore, a pin reciprocally slidable in said bore when said bore is aligned with one of said arrays of notches whereby, when inserted, said pin cooperates with said bore and said one of said arrays of notches to prevent rotation of said worm gear.

* * * * *